US007325948B2

(12) United States Patent
Kay

(10) Patent No.: US 7,325,948 B2
(45) Date of Patent: Feb. 5, 2008

(54) RECESSED LIGHT FIXTURE

(75) Inventor: Gregory L. Kay, Chicago, IL (US)

(73) Assignee: Lightology, LLC, Chicago, IL (US)

( * ) Notice: Subject to any disclaimer, the term of this patent is extended or adjusted under 35 U.S.C. 154(b) by 10 days.

(21) Appl. No.: 11/106,856

(22) Filed: Apr. 15, 2005

(65) Prior Publication Data

US 2006/0232979 A1 Oct. 19, 2006

(51) Int. Cl.
*F21S 8/02* (2006.01)

(52) U.S. Cl. ..... 362/365; 362/368; 362/148

(58) Field of Classification Search ..... 362/368, 362/147, 148, 365; 52/506.08, 506.09, 742.16, 52/741.41, 28
See application file for complete search history.

(56) References Cited

U.S. PATENT DOCUMENTS 2,716,185 A * 8/1955 Burliuk et al. ..... 362/366
6,896,833 B2 * 5/2005 Chadwick ..... 264/227
2005/0036321 A1 * 2/2005 Ward ..... 362/365

* cited by examiner

*Primary Examiner*—Sharon E. Payne
(74) *Attorney, Agent, or Firm*—Wood, Phillips, Katz, Clark & Mortimer

(57) ABSTRACT

A recessed lighting fixture for a surface defined by a panel where the light is adapted for mounting behind the surface, including a can having an opening on one side for escaping light, a mount for securing a light source in the can, and a flange member having a central opening matching the can opening. The can is mountable behind the surface with a first mounting adapter about the can opening. A second mounting adapter is about the flange member opening. A plaster flange is secured to the flange member to define a surface with an inner boundary matching the can opening and an outer boundary generally matching the panel opening. The mounting adapters are adapted to secure the flange member to the can with the plaster flange planar surface within the panel opening and substantially coplanar with the panel surface.

17 Claims, 2 Drawing Sheets

RECESSED LIGHT FIXTURE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to recessed lighting, and more particularly to aesthetic mounting of recessed lighting.

BACKGROUND OF THE INVENTION AND TECHNICAL PROBLEMS POSED BY THE PRIOR ART

Recessed lighting is used in millions of homes, offices and other buildings throughout the United States and the world. Such lights used fixtures which are mounted behind a boundary of a room (typically above the ceiling), with an opening in the boundary allowing light to emanate from the light source in the fixture to the room.

Recessed can lights are one type of recessed lighting which is widely used, both for area and spotlights. Can lights typically include a housing or can which is mounted around a socket for a suitable light bulb which is electrically wired to a light switch for turning the light off and on. Depending on the desired effect, the can may be reflective to maximize the amount of light emitted from the fixture. Such cans typically include a cylindrical opening, and are mounted to cross braces or studs behind the boundary (e.g., ceiling), with the cylindrical cans generally positioned behind a generally matching round opening in the room boundary. In new and/or retrofit installations, an installer may gain access behind the boundary through the opening for suitable mounting and wiring, after which the can may be inserted through the slightly larger boundary opening and suitably fixed to the mounting structure whereby its cylindrical opening is generally concentric with the round opening or hole in the boundary.

Of course, it is as a practical matter virtually impossible to precisely align the can so that, when mounted, there is no space between the can and the boundary opening. This is true not only because it is difficult to precisely cut an exact round shape for the boundary opening, but also because precise lines are just generally difficult to cut in materials such as plasterboard or drywall which commonly are used to define the boundary. Moreover, not only are such cuts difficult, particularly when the craftsman has to reach up and make the cut overhead in a ceiling, but such materials are of a type which may have small pieces break off when making the cuts, leaving uneven edges.

As a result, to provide an aesthetically pleasing fixture, ring shaped trim pieces have often been used, where the trim is secured to the lip of the can and extends outwardly to cover the unavoidable gap and provide a clean visible outer edge which is essentially perfectly circular. In some installations, however, the desired aesthetic design of the room is such that it is desired to have the recessed light appear integral with the boundary, without any such trim pieces. In those cases, the installer is required to plaster (commonly called spackle or "mud") the gap between the light can and the boundary opening. However, it should be appreciated that such spackling is difficult to accomplish cleanly, given that it must go right up to the lip of the can, and moreover is highly susceptible to undesirably cracking or shrinking and leaving an unacceptable gap when the plaster dries.

The present invention is directed toward overcoming one or more of the problems set forth above.

SUMMARY OF THE INVENTION

In one aspect of the present invention, a recessed lighting fixture is provided for a surface defined by a panel where the light is adapted for mounting behind the surface aligned with a panel opening with a selected configuration. The fixture includes a can having an opening on one side for escaping light, a mount for securing a light source in the can, and a flange member having a central opening matching the can opening. The can is mountable behind the surface with the can opening facing and selectively positioned in the panel opening and has a first mounting adapter about the can opening, with a second mounting adapter about the flange member opening. A plaster flange is secured to the flange member to define a substantially planar surface with an inner boundary matching the can opening and an outer boundary generally matching the panel opening. The first and second mounting adapters are adapted to selectively secure the flange member to the can with the plaster flange planar surface within the panel opening and substantially coplanar with the panel surface.

In one form of this aspect of the present invention, the panel and can openings are circular, and the can is selectively positioned with its opening concentric with the panel opening. In one further form, the first and second mounting adapters are mating screw threads. In another further form, the flange member includes a donut shaped screen adapted to support the plaster flange thereon. In still another further form, the screen is steel.

In another form of this aspect of the present invention, a panel tape is secured to the plaster flange, and the tape extends beyond the plaster flange surface to overlap the panel about the outer boundary of the plaster flange surface when the flange member is selectively secured to the can.

In another aspect of the present invention, a recessed lighting fixture is provided for a surface defined by a panel, where the light is adapted for mounting behind the surface aligned with a generally circular panel opening. The fixture includes a can having a substantially circular opening on one side for escaping light with a first mounting adapter about the can opening, a mount in the can for an electrical light, and a flange member having a central opening with a second mounting adapter about the opening. The can is mountable behind the surface with the can opening facing and substantially concentric with the panel opening. A ring shaped plaster flange is secured to the flange member, and defines a substantially planar donut shaped surface. The first and second mounting adapters are adapted to selectively secure the flange member to the can with the plaster flange donut shaped surface within the panel opening and substantially coplanar with the panel surface.

In one form of this aspect of the present invention, the flange member central opening substantially matches the can around the can opening. In a further form, the plaster flange extends substantially completely to the flange member central opening.

In another form of this aspect of the present invention, the mount is a light socket.

In still another form of this aspect of the present invention, the first and second mounting adapters are mating screw threads.

In yet another form of this aspect of the present invention, a donut shaped panel tape is secured to the plaster flange, with the tape extending beyond the plaster flange donut shaped surface to overlap the panel about the outer periphery of the plaster flange donut shaped surface when the flange member is selectively secured to the can.

According to still another form of this aspect of the present invention, the flange member includes a donut shaped screen adapted to support the plaster flange thereon. In a further form, the screen is steel.

In still another aspect of the present invention, a method of installing a recessed lighting fixture is provided, comprising the steps of (1) cutting a hole in a panel surface, the hole having a selected shape and size, (2) mounting a recessed light can behind the panel surface, the light can having an opening on one side for escaping light, (3) mounting a flange member with a ring shaped plaster flange to the can about the can opening, whereby the plaster flange defines a surface which is substantially coplanar with the panel surface and extends outwardly from the can opening to an outer boundary substantially matching the selected shape and slightly smaller than the selected size, and (4) spackling the joint between the panel surface and the plaster flange.

In one form of this aspect of the present invention, the selected shape is circular.

In another form of this aspect of the present invention, the hole in the panel surface and the light can opening are substantially concentric circles, and the flange member mounting step comprises threading the flange member onto the can.

In still another form of this aspect of the present invention, a panel tape is secured to the plaster flange during the flange member mounting step, with a portion of the tape extending beyond the outer boundary of the plaster flange. In a further form, during the flange member mounting and the spackling steps, the portion of the tape extending beyond the outer periphery of the plaster flange is pressed against the panel surface surrounding the hole in the panel surface.

DETAILED DESCRIPTION OF THE INVENTION

Figure 1:
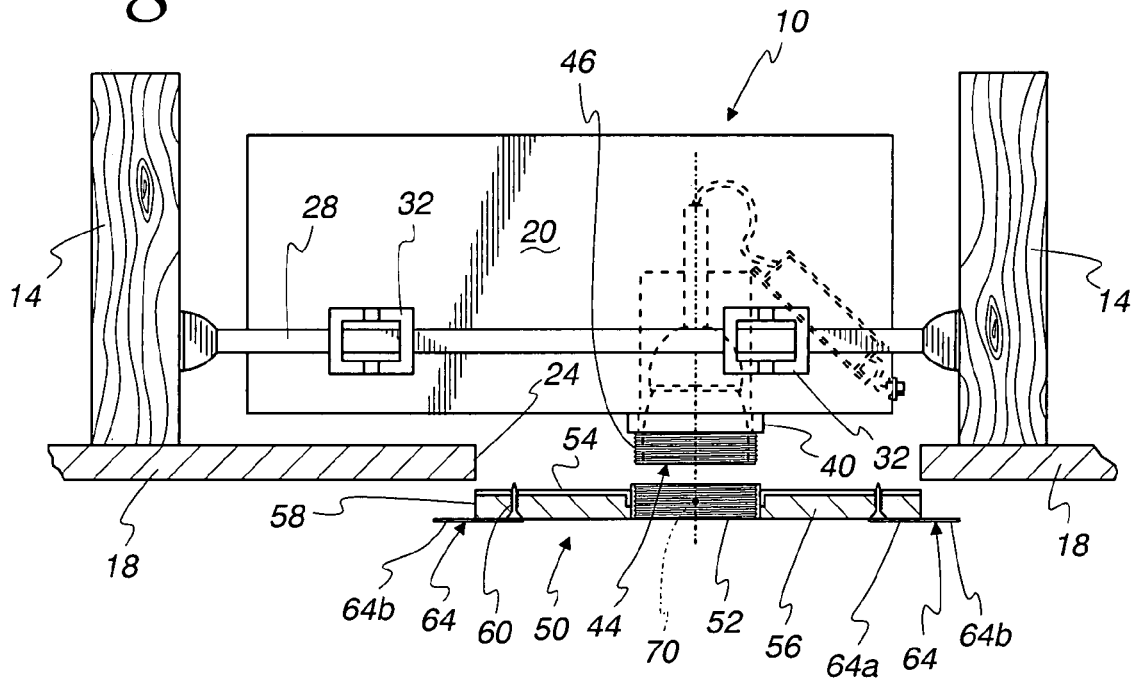
FIG. 1 is a side, partial cross-sectional view of a recessed light fixture in a ceiling according to the present invention.
Figure 3:
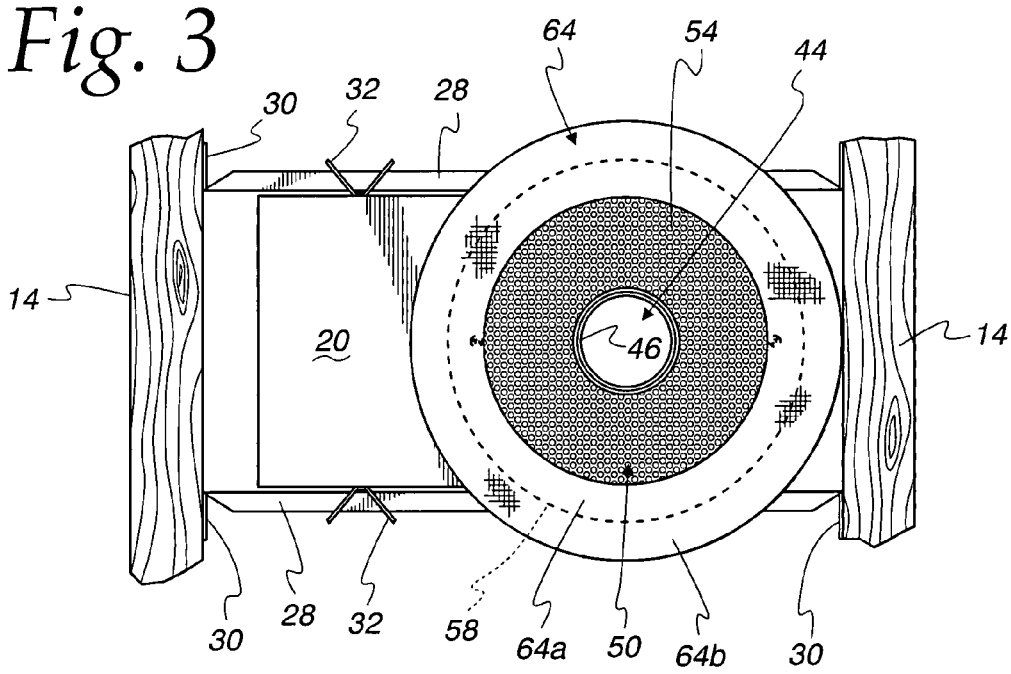
FIG. 3 is a view from below of the FIG. 1 embodiment, with the ceiling removed for illustration purposes and the underlying steel screen of the flange member partially visible (i.e., with the plaster portion not visible)

A first embodiment of the present invention is shown in FIGS. 1 and 3. As illustrated therein, the recessed light fixture 10 may is suitably supported between two studs or beams 14 beneath which is supported a suitable ceiling panel 18 made of, for example, drywall. While reference and description will be made herein to ceiling installations, it should be appreciated that the present invention may be advantageously used with essentially any space boundary, including not only ceilings, but also side walls.

A housing 20 for the fixture 10 (as typically required by building codes) may be suitably mounted behind (above) the ceiling panel 18. As illustrated, an opening 24 is cut through the panel 18. In the illustrated embodiment, the opening 24 is generally cylindrical or circular, although it should be appreciated as described further below that it may be another selected shape. Access behind the ceiling panel 18 may be had through the opening 24, for locating fixture components behind the panel 18 and for the installer to reach therein as necessary for installation.

It should be understood that, for simplicity of illustration, the electrical wiring typically included with recessed light fixtures has been omitted from the figures.

Mounting braces or brackets 28 may be suitably mounted between the beams 14 (e.g., by screwing bracket feet 30 thereto), and suitable connectors 32 may be provided for supporting the housing 20 on the brackets 28. As illustrated, the feet 30 may be readily mounted to the beams 14, even in retrofit applications. It should be understood, however, that still other mounting structures could be suitably used with the present invention. For example, in new construction, the brackets on either end may advantageously include a downwardly depending leg with a horizontal foot extending beneath the beam 14, whereby the foot is secured to the bottom of the beam 14 (between the beam 14 and the ceiling panel 18).

Suitably secured to the housing 20 is the recessed light can 40. A desired light source, such as an incandescent light bulb, may be secured in the can 40 (e.g., in a suitable socket), with a cylindrical opening 44 for escaping light being at the bottom of the can 40. It should be understood, however, that the present invention may be used with virtually any light source, including incandescent and Halogen lights, and area and spot lights, with the choice of light source being determined based on the desired lighting for the room.

In accordance with the present invention, the outer surface of the can 40 includes a threaded portion 46.

Also in accordance with the present invention, a flange member 50 is provided, including a cylindrical central opening 52, an annular flange 54 extending outwardly from the central opening 52, and a suitable ring shaped plaster portion 56 suitably secured to the flange 54 and extending from an inner boundary abutting the central opening 52 to a cylindrical outer boundary 58 slightly smaller than the ceiling panel opening 24.

The cylindrical central opening 52 is threaded on its inner surface with threads which mate with the can threaded portion 46, whereby the flange member 50 may be screwed onto the can 40.

The flange 54 may consist of a steel screen (see FIG. 3), with the plaster portion 56 formed thereon. The texture and openings of the flange 54 may thus be sufficient to ensure that the plaster portion 56, which may be formed wet thereon, will adequately secure thereto. Further, the flange 54 may also readily accept mounting screws 60 (see FIG. 1) to further assist in ensuring the securement together of the plaster portion 56 and flange 54.

Moreover, it should be appreciated that the plaster portion 56 may be readily formed on the flange 54 prior to installation, with an smooth circular outer boundary matching the flange 54 shape. For example, a suitable cylindrical mold may be used to define such an outer boundary when the plaster forming the portion is placed on the flange 54. Moreover, such manufacture may be more readily accomplished than if required to be done at the location of the light 10 (e.g., by placing the plaster on top of the upwardly facing flange 54 in a repetitive operation at a manufacturing facility, as opposed to having to reach up and place plaster on a downwardly facing ceiling surface). Also, whereas consistent clean lines around the can opening have heretofore further been particularly difficult to achieve due to the variously skilled large numbers of individual drywallers who have had to perform the task at each construction site, the present invention may much more readily allow for the manufacture of consistently clean lines. Still further, the present invention provides for reliable formation of the plaster portion 56 against the central opening 52, without a crack developing as the plaster dries, and without portions of the plaster extending onto the clean and negatively impacting the aesthetic appearance of the installed light 10.

Instead, individual drywallers are required only to plaster (or spackle or "mud") a joint of a type which they do all the time and are therefore reliably and suitably skilled to do so. Specifically, installation requires spackling over the annular seam between the ceiling opening 24 and the outer boundary of the plaster portion 56.

A suitable seam tape 64 such as is known for use in spackling drywall joints is provided on the plaster portion 56. Rather than straight tape such as conventionally comes in rolls, the tape 64 may advantageously be in the shape of a ring with an inner portion 64*a* stuck to the plaster portion 56 and an outer portion 64*b* extending beyond the outer boundary 58 of the plaster portion 56. As is known, tape of this type assists in ensuring that cracks do not develop in the spackle at the joint as the spackle dries.

The tape 64 may advantageously be provided in the form of separate annular or donut shaped rings of a suitable size, with the tape 64 adhered immediately before threading together of the flange member 50 and can 40, or the tape may be applied after threading of the flange member 50 to the can 40. If necessary to protect the adhesive of the tape 64, a suitable backing material may be provided, and/or multiple rings of tape 64 may be provided in a stack. However, it should be understood that any tape suitable for drywall joints may be advantageously used, including flat tape and mesh tape, and the tape may be provided on the joint in any suitable manner, including straight portions of tape applied at angles to one another to approximate the circular shape of the joint between the plaster portion 56 and the ceiling panel 18.

In the FIGS. 1 and 3 embodiment, it should be appreciated that the can 40 should be secured so that the lip around its opening 44 is parallel to the bottom surface of the ceiling panel 18 and concentric with the circular opening 24 in the ceiling. The flange member 50 is then mounted onto the can 40 by turning the flange member 50 and screwing its threaded central opening 52 onto the can threaded portion 46. The flange member 50 should be rotated to continue threading onto the can 40 until the bottom surface of the plaster portion 56 is substantially coplanar with the bottom surface of the ceiling panel 18. At that position, the outer portion 64*b* of the tape 64 will overlap with and engage the ceiling panel 18. Of course, the installer may press the tape against the ceiling to ensure good desired sticking. Thereafter, the installer may spackle the circular joint over the tape 64 in a manner which any reasonable competent drywaller can accomplish and frequently does, rather then being required to spackle the difficult area directly around the can opening 44.

A set screw 70 may be used to secure the flange member 50 and can 40 in that desired position.

Figure 2:
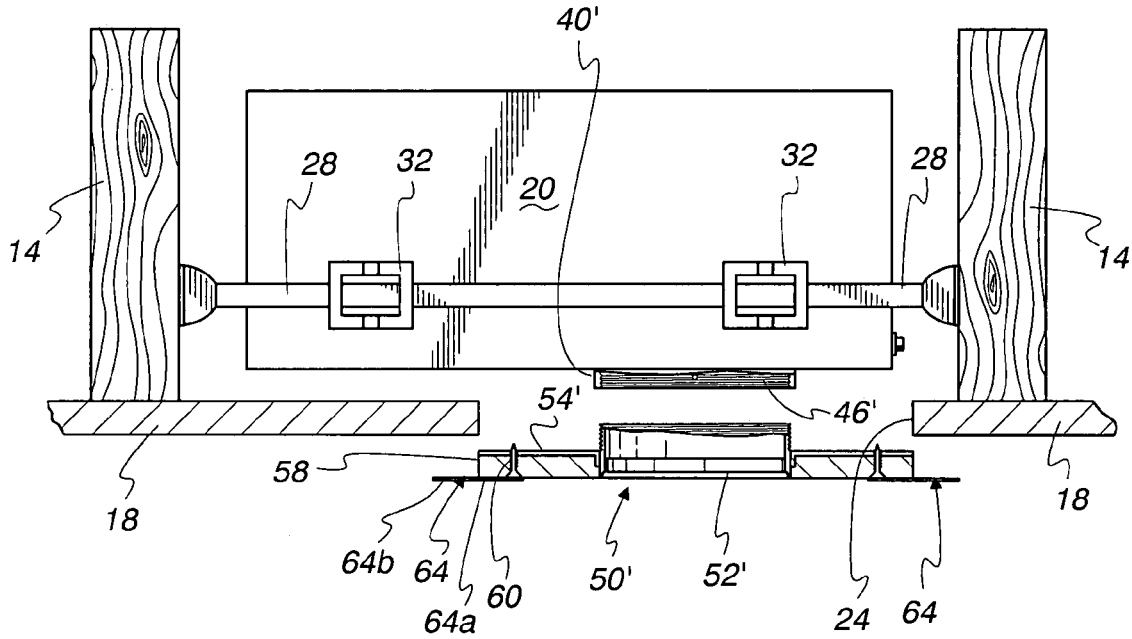
FIG. 2 is a side, partial cross-sectional view of a recessed light fixture in a ceiling according to another form of the present invention
Figure 4:
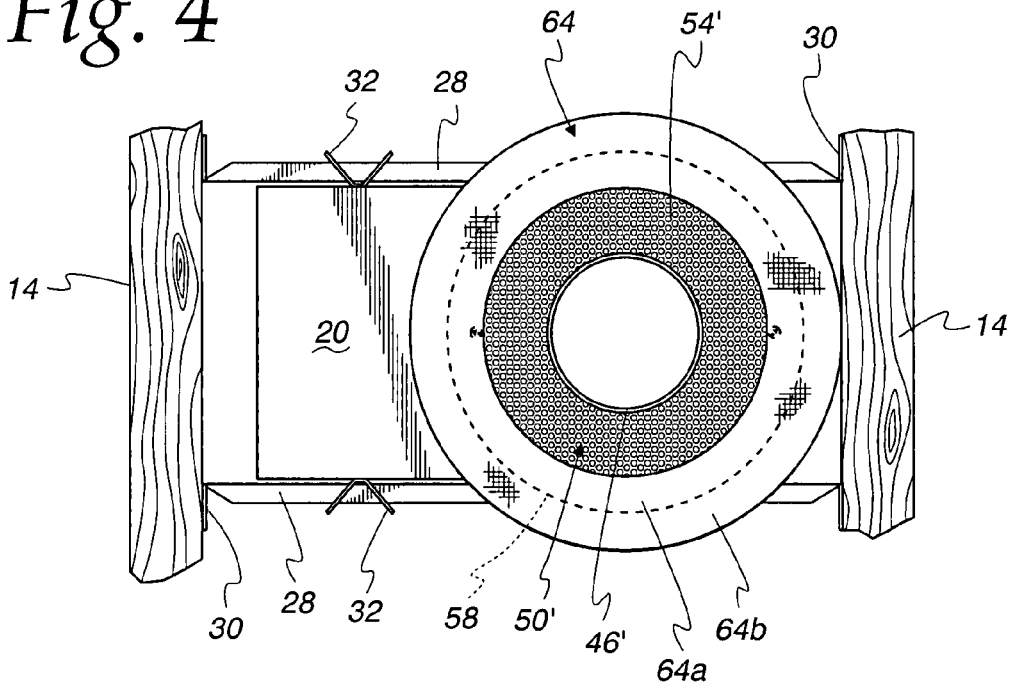
FIG. 4 is a bottom view similar to FIG. 3, showing the FIG. 2 form of the invention.

FIGS. 2 and 4 show a second embodiment of the present invention. This embodiment is similar in many respects to the FIGS. 1 and 3 embodiment, and therefore the same reference numerals are used in illustrating this second embodiment, with similar but modified components having the same reference number plus prime ("'"). With this second embodiment, the flange member 50' has a central opening 52' threaded on the outside surface, with the can 40' having its threaded portion 46' on the inside.

It should be understood, however, that still other embodiments may be used which incorporate the present invention. For example, while a circular/cylindrical shape may be advantageously used as described, particularly when the flange member 50 is rotated to advantageously position it on the can 40 by threading the two together, it would be within the scope of the present invention to secure the flange member 50 and can 40 together in other manners. For example, the two may be simply telescopically slid together and then suitably secured, as by set screws. In that case, since the flange member would not be rotated during installation, the flange member outer boundary 58 could essentially be any suitable shape which generally matches the shape, and is slightly smaller than, the opening in the ceiling (or wall), enabling it to be moved into the ceiling opening during installation to align its bottom surface and the ceiling bottom surface in the same plane.

It should also be understood that the present invention eliminates the need to occasionally extend out the opening in the ceiling panel such as has occurred in the prior art, when the hole needed to be extended to the beams or studs to provide a base for securing a patch piece. With the present invention, the can 40 serves as a central base to which the flange member 50 may be secured, so that the ceiling opening 24 may be consistently located and sized at each light fixture 10 independent of the location of the beams or studs 14.

It should still further be understood that while reference is made herein to drywall and plaster, the present invention may also be advantageously used with different materials in which similar installation issues and limitations exist. For example, the present invention could also be used in connection with plaster walls which are not drywall panels such as often used in today's construction, or could be used in connection with still other ceiling and wall materials which would require that material seams or joints be hidden and which could more easily be hidden when the joint is formed between two adjacent flat surfaces. Therefore, "panel" has been used herein to broadly describe wall materials, though it should further be understood that such use is also not intended to be limited to any narrow or precise definition of that term.

Moreover, it should also be understood that such joints may be advantageously hidden by use of materials which might not, in some definitions, strictly fit some narrow definition of "plaster" (i.e., a mixture of lime with sand or cement and water), and that the present invention contemplates the use of all such materials. As such, "plaster" as used herein is not intended to be limited to mixtures in which, for example, binding is accomplished by lime or fluidity is provided by water.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A recessed lighting fixture for a surface defined by a panel, said light being adapted for mounting behind said surface aligned with a panel opening with a selected configuration, comprising:

a can having an opening on one side for escaping light, said can being mountable behind said surface with said can opening facing and selectively positioned in said panel opening, and having a first mounting adapter about said can opening;

a mount for securing a light source in said can; and a flange member having a central opening matching said can opening with a second mounting adapter about said central opening;

a plaster flange secured to said flange member, said plaster flange defining a substantially planar surface with an inner boundary matching said can opening and an outer boundary generally matching said panel opening;

wherein said first and second mounting adapters are adapted to selectively secure said flange member to said can with said plaster flange planar surface within said panel opening and substantially coplanar with said panel surfaces, said panel and can openings are circular, and said can is selectively positioned with its opening concentric with said panel opening, and said flange member includes a donut-shaped screen adapted to support the plaster flange thereon.

2. The fixture of claim 1, wherein said first and second mounting adapters are mating screw threads.

3. The fixture of claim 1, wherein said screen is steel.

4. The fixture of claim 1, further comprising a panel tape secured to said plaster flange, said tape extending beyond said plaster flange surface to overlap said panel about the outer boundary of said plaster flange surface when said flange member is selectively secured to said can.

5. A recessed lighting fixture for a surface defined by a panel, said light being adapted for mounting behind said surface aligned with a generally circular panel opening, comprising:

a can having a substantially circular opening on one side for escaping light, said can being mountable behind said surface with said can opening facing and substantially concentric with said panel opening, and having a first mounting adapter about said can opening;

a mount in said can for an electrical light; and a flange member having a central opening with a second mounting adapter about said opening;

a ring-shaped plaster flange secured to said flange member, said plaster flange defining a substantially planar donut-shaped surface and adapted to be received in said panel opening;

wherein said first and second mounting adapters are adapted to selectively secure said flange member to said can with said plaster flange donut-shaped surface within said panel opening and substantially coplanar with said panel surface, and said flange member includes a donut-shaped screen adapted to support the plaster flange thereon.

6. The fixture of claim 5, wherein said flange member central opening substantially matches said can around said can opening.

7. The fixture of claim 6, wherein the plaster flange extends substantially completely to said flange member central opening.

8. The fixture of claim 5, wherein said mount is a light socket.

9. The fixture of claim 5, wherein said first and second mounting adapters are mating screw threads.

10. The fixture of claim 5, further comprising a donut shaped panel tape secured to said plaster flange, said tape extending beyond said plaster flange donut-shaped surface to overlap said panel about the outer periphery of said plaster flange donut-shaped surface when said flange member is selectively secured to said can.

11. The fixture of claim 5, wherein said screen is steel.

12. A method of installing a recessed lighting fixture, comprising the steps of:

cutting a hole in a panel surface, said hole having a selected shape and size; mounting a recessed light can behind said panel surface, said light can having an opening on one side for escaping light;

providing a flange member with a ring shaped plaster flange about said can opening, defining a plaster surface which extends outwardly from adjacent said can opening to an outer boundary substantially matching said selected shape and slightly smaller than said selected size screwing the flange member onto said can about said can opening until said plaster flange defines a surface which is substantially coplanar with said panel surface; and spackling the joint between the panel surface and the plaster flange.

13. The method of claim 12, wherein said selected shape is circular.

14. The method of claim 13, wherein said hole in said panel surface and said light can opening are substantially concentric circles, and said ring shaped plaster flange substantially fills the area between said concentric circles.

15. The method of claim 12, wherein a panel tape is secured to said plaster flange during the flange member mounting step, with a portion of said tape extending beyond the outer boundary of said plaster flange.

16. The method of claim 15, wherein during said flange member mounting and said spackling steps, said portion of said tape extending beyond the outer periphery of said plaster flange is pressed against said panel surface surrounding said hole in said panel surface.

17. A recessed lighting fixture for a surface defined by a panel, said light being adapted for mounting behind said surface aligned with a panel opening with a selected configuration, comprising:

a can having an opening on one side for escaping light, said can being mountable behind said surface with said can opening facing and selectively positioned in said panel opening, and having a first mounting adapter about said can opening;

a mount for securing a light source in said can; and a flange including a flange member having a central opening matching said can opening with a second mounting adapter about said central opening, and a plaster flange secured to said flange member, said plaster flange defining a substantially planar face with an inner boundary matching said can opening and an outer boundary generally matching said panel opening;

whereby said first and second mounting adapters are adapted to selectively secure said flange member to said can with said plaster flange surrounding and abutting said flange member central opening and extending outwardly from said central opening to adjacent the panel opening with said planar face substantially coplanar with said panel surface around the panel opening.

* * * * *

UNITED STATES PATENT AND TRADEMARK OFFICE

CERTIFICATE OF CORRECTION

PATENT NO. : 7,325,948 B2
APPLICATION NO. : 11/106856
DATED : February 5, 2008
INVENTOR(S) : Gregory L. Kay It is certified that error appears in the above-identified patent and that said Letters Patent is hereby corrected as shown below:

Column 7, line 29, delete “surfaces” and substitute therefor --surface--.

Column 8, line 25, after “opening” delete “,”.

Signed and Sealed this

Twenty-second Day of July, 2008

JON W. DUDAS
*Director of the United States Patent and Trademark Office*